US006591895B2

(12) United States Patent
Tabatabaei et al.

(10) Patent No.: US 6,591,895 B2
(45) Date of Patent: Jul. 15, 2003

(54) MOLTEN METAL POURING WITH RETRACTABLE SHIELD FOR POUR CONTROL

(75) Inventors: Emad Tabatabaei, Voorhees, NJ (US); William R. Pflug, Mount Laurel, NJ (US)

(73) Assignee: Inductotherm Corp., Rancocas, NJ (US)

( * ) Notice: Subject to any disclaimer, the term of this patent is extended or adjusted under 35 U.S.C. 154(b) by 0 days.

(21) Appl. No.: 09/957,158

(22) Filed: Sep. 20, 2001

(65) Prior Publication Data

US 2002/0104638 A1 Aug. 8, 2002

Related U.S. Application Data

(60) Provisional application No. 60/234,616, filed on Sep. 22, 2000.

(51) Int. Cl.[7] ..... B22D 37/00

(52) U.S. Cl. ..... 164/457; 164/133; 164/337; 222/594; 222/602; 222/607

(58) Field of Search ..... 164/133, 134, 164/135, 136, 335, 336, 337, 437, 438, 439, 457; 222/590–607, 629, 108–111

(56) References Cited

U.S. PATENT DOCUMENTS 2,957,936 A * 10/1960 Bugge ..... 164/337
5,465,777 A * 11/1995 Brunner ..... 164/136

FOREIGN PATENT DOCUMENTS

GB 2128520 * 5/1984

* cited by examiner

*Primary Examiner*—Kuang Y. Lin
(74) *Attorney, Agent, or Firm*—Philip O. Post

(57) ABSTRACT

Apparatus for pouring of molten metal from a vessel onto the gating system of a mold includes a shield assembly that diverts any abnormal flow of molten metal occurring between normal flow of molten metal onto the gating system when molds are indexed for pouring. The shield assembly protects sensitive components of the mold, such as the gating and casting patterns in a lost foam casting process, from abnormal flow of molten metal.

5 Claims, 3 Drawing Sheets

MOLTEN METAL POURING WITH RETRACTABLE SHIELD FOR POUR CONTROL

CROSS-REFERENCE TO RELATED APPLICATIONS

This application claims the benefit of U.S. Provisional Application No. 60/234,616 filed Sep. 22, 2000.

FIELD OF THE INVENTION

The present invention relates to molten metal pouring with a retractable shield for improved control of the flow of molten metal into a mold during a casting process, particularly when mold components or equipment are exposed to abnormal flow of molten metal.

BACKGROUND OF THE INVENTION

Generally the art of metal casting can be described as the pouring of molten metal from a vessel, such as a tundish, into the gating system of a mold to fill cavities that represent the articles to be cast. In an automated casting line, molds are consecutively placed (indexed) with the gating system under the nozzle of the tundish, and a normal flow of molten metal flows through the nozzle into the gating system. Between normal filing of consecutive molds, the normal flow of molten metal is blocked by a stopper placed over the opening in the nozzle as the filled mold is replaced by a fresh mold in the indexed position underneath the nozzle. While the stopper generally prevents the flow of molten metal during this "dwell time" period, abnormal flows of molten metal, such as drippings or irregular flows from a leaking nozzle, will sometimes occur during the dwell time.

In one type of casting process, known as the "Lost Foam" casting process, a foam (typically a low density organic compound) cluster of connected patterns comprising a foam gating system and foam patterns of the articles to be cast is embedded in sand within a mold container. Molten metal is poured onto the top of the foam gating system and evaporates the foam as it progresses through the gating system and into the interconnected foam patterns that represent the articles to be cast. In a properly executed lost foam casting process, the metal replaces the entire cluster of foam patterns to exactly duplicate all of the features of the original patterns.

The lost foam process requires that the flow of molten metal be smooth and quickly executed onto the gating system foam and through the foam patterns as it displaces the evaporated foam. An abnormal flow pattern, such as the discontinuous dripping or trickling of molten metal from the flow nozzle between termination of a pour for a first mold and the beginning of a pour for a second mold, can result in deformed castings being formed in the second mold. One known solution is to protect the top of the foam gating system with a sheet of aluminum foil. The sheet will generally repel non-continuous molten metal droplets but will not protect the foam when the abnormal flow pattern is more continuous when, for example, the nozzle leaks a stream of molten metal. An alternative known solution is to blow away molten metal droplets before they reach the top of the foam gating system by using what is known as an air knife. The air knife requires a compressed air source, produces a loud sound from the release of the compressed air, and propels molten metal droplets in a manner that can be a safety hazard.

Therefore, there exists the need for a simple and efficient apparatus and method for shielding the top of a foam gating system by diverting abnormal flow patterns of molten metal from the top of the foam gating system.

SUMMARY OF THE INVENTION

In its broadest aspect, the present invention is an apparatus and a method for pouring molten metal from a vessel onto the gating system of a mold. A nozzle in the vessel directs flow of the molten metal from the vessel onto the gating system. A stopper is used to control the flow of molten metal through the nozzle. A retractable shield is placed between the outlet of the nozzle and the top of the gating system of the mold to divert abnormal flow from the nozzle from the top of the gating system.

These and other aspects of the invention will be apparent from the following description.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

Figure 1:
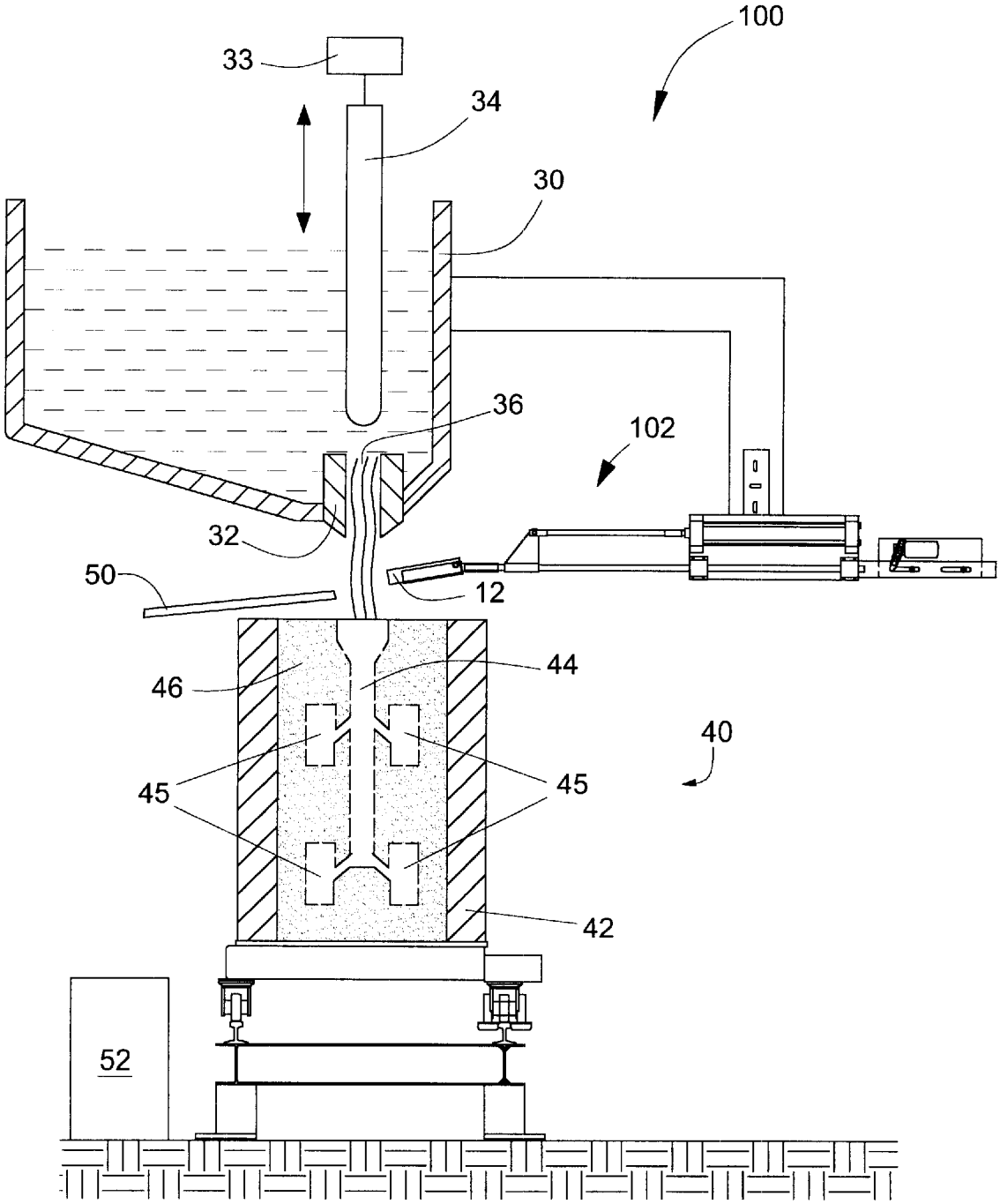
FIG. 1 is an elevational partial cross sectional view of one example of the molten metal pouring apparatus of the present invention, with the retractable shield assembly shown in the retracted position.
Figure 2:
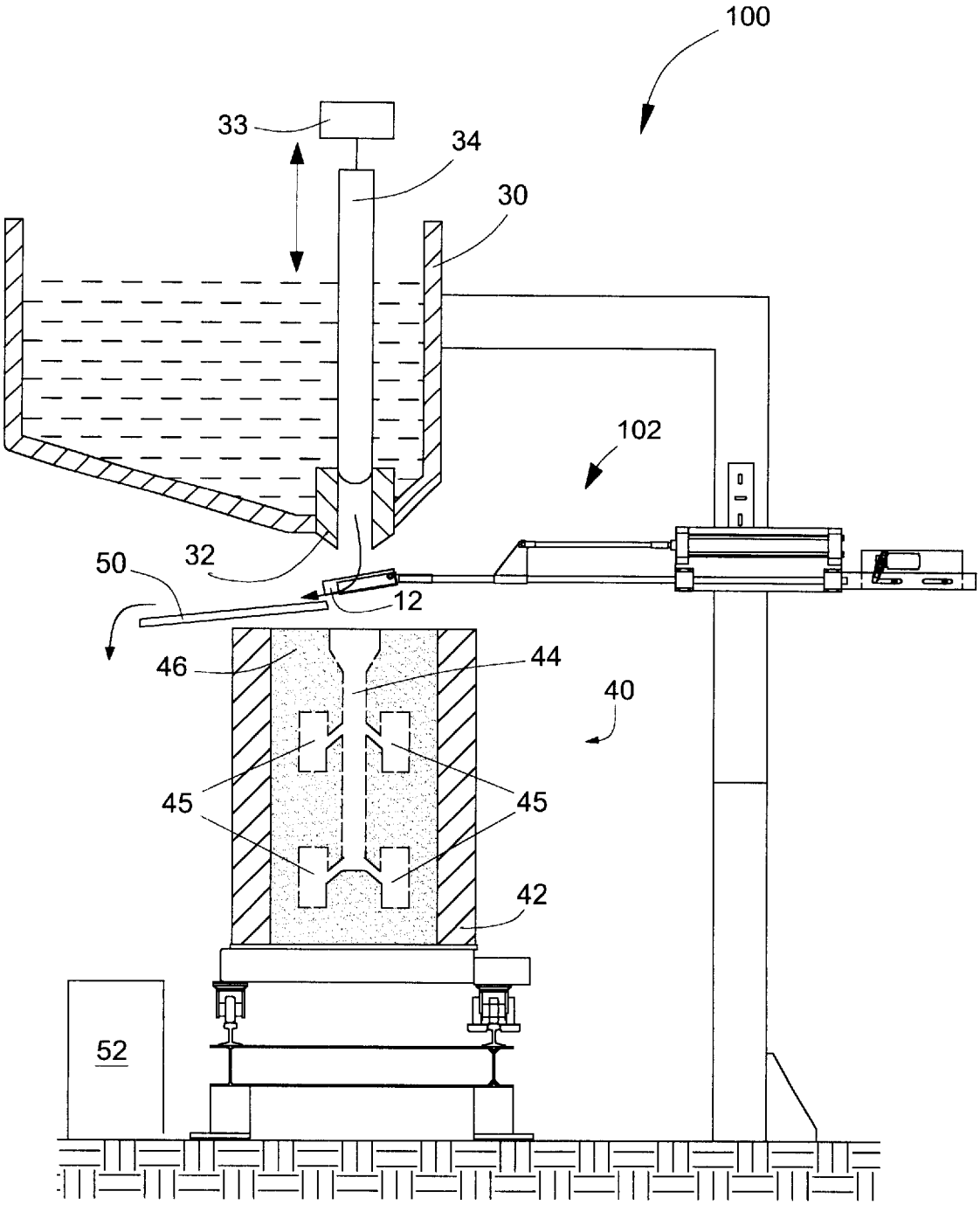
FIG. 2 is an elevational partial cross sectional view of one example of the molten metal pouring apparatus of the present invention, with the retractable shield assembly shown in the diverting position.

One example of the pouring apparatus 100 of the present invention is shown in FIG. 1 and FIG. 2. Pouring vessel 30 holds molten metal that is released through nozzle 32 when stopper 34, which is reciprocally movable as indicated by the double-headed arrow in FIG. 1, is raised off of the opening 36 in the nozzle. Pouring vessel 30 is generally moveable to accommodate varying mold configurations. Lost foam mold 40 is indexed under nozzle 32. Mold 40 comprises foundry container 42; a cluster of connected lost foam patterns consisting of a foam gating system 44 and foam patterns 45 of the articles to be cast (diagrammatically shown); and sand 46 packed around the cluster of foam patterns. Shield assembly 102 is shown in the retracted position in FIG. 1 and a normal flow of molten metal flows onto the top of the gating system 44. Preferably the shield assembly is attached directly or indirectly to vessel 30 so that the shield will remain properly oriented under the nozzle 32 as the moveable vessel 30 changes positions for different mold configurations. As described above, the molten metal evaporates the foam pattern as it penetrates foam gating system 44 and attached foam patterns 45 of the articles to be cast.

In FIG. 2, shield assembly 102 is shown in the diverting position. When the shield assembly is in the diverting position, any unwanted flow of molten metal will be diverted from the top of the gating system in the direction shown by the arrows and as further described below. Typically, once a normal molten metal flow is terminated by seating stopper 34 on the opening 36 in nozzle 32 at the completion of filling the indexed mold, the shield assembly 102 will move from the retracted position shown in FIG. 1 into the diverting position shown in FIG. 2. A mold transport system (such as the wheels and rails shown in FIG. 1 and FIG. 2) will then move filled mold 40 from the indexed position and move a new mold into the indexed position under the nozzle. During this non-pouring (dwell) time period of transitioning between molds under the nozzle, shield assembly 102 will shield the top of the gating system from potential abnormal molten metal flows from the nozzle caused, for example, by poor seating of the stopper on the opening 36 in the nozzle 32. The shield assembly 102 will also protect any sensitive auxiliary equipment located under the molds that may be exposed to the irregular molten metal flows during the transition between molds.

Figure 3:
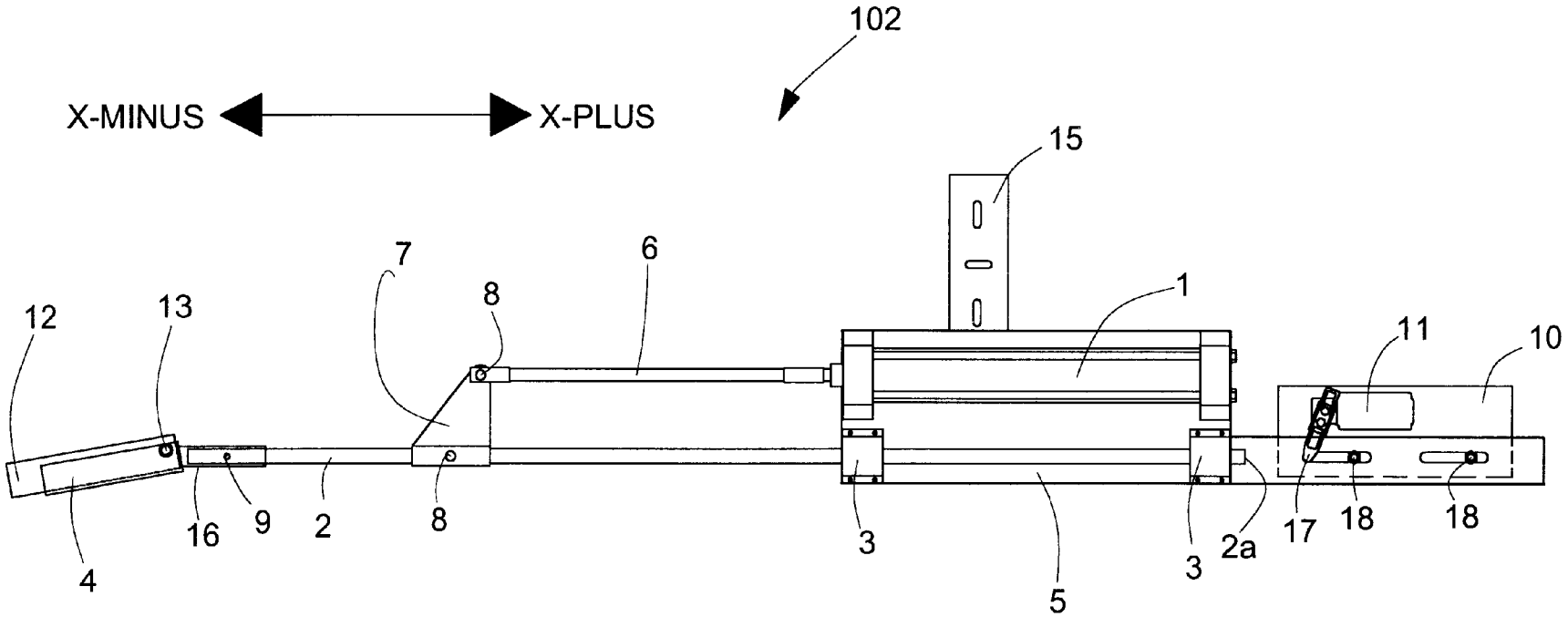
FIG. 3 is an elevational view of one example of a retractable shield assembly of the present invention used with the molten metal pouring apparatus shown in FIG. 1 and FIG. 2.

One example of a shield assembly 102 is shown in detail in FIG. 3. Linear drive device 1, such as a pneumatic cylinder, drives rod 6 alternately in either the x-plus direction or x-minus direction as indicated by the arrows in FIG. 3. Linear drive device 1 is attached to first structural element 5. Shaft 2 is held in place by sliding supports 3, such as linear bearings, which are also attached to first structural element 5. Shaft 2 is free to slide in the x-plus and x-minus directions when the cylinder is stroked. Rod 6 is suitably connected to shaft 2 by means that will transmit linear movement of rod 6 to shaft 2. The means of connections shown in the present example is a drive link member 7, which is attached to the shaft and rod by pins 8.

Shield element 12 is suitably attached to a first end of shaft 2. In the example shown, mounting bracket 4 is attached to the first end of the shaft by a sleeve 16 that slips over the first end of the shaft. Quick release pin 9 holds the sleeve on the shaft. Shield element 12 is attached to mounting bracket 4 by one or more fasteners 13, which may be stainless steel. The mounting bracket 4 provides means for supporting shield element 12 and can be formed from a suitable material such as stainless steel. Shield element 12 is supported at an angle below the horizontal (defined by the x-minus and x-plus axis). In the present example, in longitudinal cross section (not shown in the drawings), shield element 12 forms a substantially V-shaped trough. The V-shape and longitudinal tilting of the shield element below the horizontal as shown in the figures allows the abnormal molten metal flow to be directed down the length of the shield and away from the top of the foam gating system, as shown by the arrow in FIG. 2, when the shield assembly is in the diverting position.

Limit switch 11 is mounted on plate 10, which is adjustably attached to first structural element 5. Slots are provided in first structural element 5 to allow adjustable positioning of the limit switch's actuating lever 17 relative to the location of the second end 2*a* of shaft 2 as further described below. Set screws 18 are used to fix the limit switch 11 in a selected position.

When proper operating conditions are satisfied for the pour of molten metal onto the top of the gating system for a mold indexed under the nozzle, driver 1 moves rod 6 and connected shaft 2 in the x-plus direction to the retraced position to enable flow of molten metal through nozzle 32 and onto the top of the gating system. The diverting shield is removed from under the nozzle 32 responsive to the mold reaching the indexed position. Second end 2*a* of shaft 2 will push against actuating lever 17 of limit switch 11 when the shield assembly reaches the retraced position to activate a limit indication, such as closure of switch contacts. The limit indication can be used as the source of a "ready to pour" signal to the stopper's control means 33, such as an electronic circuit, so that the stopper 34 is raised and a flow of molten metal commences through the nozzle 32 and onto the top of the gating system of the indexed mold. When the indexed mold is filled and the stopper 34 lowers onto the opening 36 in the nozzle 32, the stopper's control means 33 can be arranged to send a signal to the control means for driver 1 to move rod 6 and connected shaft 2 in the x-minus direction to place shield assembly 102 in the diverting position so that shield element 12 diverts any abnormal flow of molten metal as diagrammatically shown by the arrows in FIG. 2.

Shield assembly 102 is preferably attached directly or indirectly to vessel 30, as noted above, by a suitable attachment bracket 15. Bracket 15 has a plurality of openings to receive fasteners to attach bracket 15 to vessel 30. The openings are preferable elongated and arranged orthogonally, to provide a degree of adjustment when positioning shield assembly relative to nozzle 32 of vessel 30. Of course, bracket 15 need not be attached to vessel 30, but may be attached to other structures as desired.

In the example shown in FIG. 1 and FIG. 2, a fixed shield element 50 is optionally used in conjunction with retractable shield element 12. With the presence of fixed shield element 50 at the pouring station where an indexed mold is filled with molten metal, when shield assembly 102 is in the diverting position any abnormal molten metal flows down the length of the retractable shield element 12 and onto the fixed shield element 50, which is arranged to direct the flow away from the mold and into retaining vessel 52. Fixed shield element 50 may be eliminated in installations where it is acceptable to have the abnormal flow to drip onto the top of the sand 46 of a mold from the retractable shield element.

Shield elements 12 and 50 (if used) can be fabricated from a suitable refractory, such as graphite, to withstand the temperature of molten metal. Graphite is particularly suitable since it does not chemically react with most molten metals and provides a smooth flowing surface for the abnormal molten metal flow.

In alternative configurations shaft 2 may be mechanically linked to the lifting and lowering means for stopper 34 so that raising the stopper off of the nozzle's opening will move the shield assembly to its retraced position and lowering the stopper on to the nozzle's opening will move the shield assembly to its diverting position. The artisan will appreciate that other alternative arrangements are possible without deviating from the scope of the present invention.

The foregoing embodiments do not limit the scope of the disclosed invention. The scope of the disclosed invention is covered in the appended claims.

What is claimed is:

1. A method of diverting an abnormal flow of molten metal from a nozzle of a vessel onto a gating system of a mold moving into an indexed position under the nozzle, the method comprising the following steps:

sensing the completion of a normal molten metal flow from the nozzle by the lowering of a stopper onto the opening in the nozzle;

moving a diverting shield to the diverting position under the outlet of the nozzle responsive to sensing the completion of the normal molten metal flow from the nozzle whereby the abnormal flow of molten metal is diverted away from the top of the gating system of the mold moving into an indexed position under the nozzle; and removing the diverting shield from under the nozzle responsive to the mold reaching the indexed position to allow molten metal flow from the nozzle onto the top of the gating system of the mold.

2. The method of claim 1, comprising the step of enabling unseating of the stopper on the opening in the nozzle responsive to removing the diverting shield away from under the nozzle whereby the normal molten metal flow is initiated from the nozzle to the top of the gating system.

3. Apparatus for pouring a molten metal from a vessel, the apparatus comprising:

a nozzle disposed in the vessel whereby a normal flow of the molten metal through the nozzle pours onto the top of a gating system of a mold indexed under the vessel;

a stopper within the vessel whereby the normal flow of the molten metal through the nozzle can be terminated by lowering the stopper onto the opening in the nozzle;

a shield retractably disposed between the outlet of the nozzle and the top of the gating system; and a control means for moving the shield to a retracted position to allow the flow of the molten metal onto the top of the gating system and for moving the shield to a diverting position to divert the flow of the molten metal from the top of the gating system, whereby the shield moves to the retracted position when the gating system of a mold is indexed under the vessel and moves to the diverting position when the stopper is lowered onto the opening in the nozzle to deflect the molten metal away from the top of the gating system when the stopper has terminated the normal flow of the molten metal.

4. Apparatus for pouring a molten metal from a vessel, the apparatus comprising:

a nozzle disposed in the vessel whereby a normal flow of the molten metal through the nozzle pours onto the top of a gating system of a mold indexed under the vessel;

a stopper within the vessel whereby the normal flow of the molten metal through the nozzle can be terminated by lowering the stopper onto the opening in the nozzle;

a shield retractably disposed between the outlet of the nozzle and the top of the gating system, the shield comprising:

a drive device for driving a rod, the drive device attached to a first structural element;

a shaft attached to the first structural element by sliding support means;

a connecting means between the rod and the shaft whereby driving the rod with the drive device will slide the shaft;

a shield element connected to a first end of the shaft; and a limit switch attached to the first structural element, the limit switch having an actuating lever, the actuating lever disposed relative to a second end of the shaft to engage the second end of the shaft when the shaft slides to a position in which the shield element does not divert the flow of the molten metal from the nozzle to the top of the gating system;

a control means for moving the shield to a retracted position to allow the flow of the molten metal onto the top of the gating system and for moving the shield to a diverting position to divert the flow of the molten metal from the top of the gating system, whereby the shield moves to the retracted position when the gating system of the mold is indexed under the vessel and moves to the diverting position when the stopper is lowered onto the opening in the nozzle to deflect the molten metal away from the top of the gating system when the stopper has terminated the normal flow of the molten metal.

5. Apparatus for diverting the flow of a molten metal through the opening in a nozzle in a vessel, the apparatus comprising:

a drive means;

a shield element connected to the drive means; and a control means for activating the drive means to move the shield element to a retracted position to allow the flow of the molten metal onto the top of a gating system of a mold when the mold is indexed under the vessel, and for activating the drive means to move the shield element to a diverting position to divert the flow of the molten metal away from the top of the gating system when the stopper is lowered onto the opening in the nozzle.

* * * * *